United States Patent [19]

Preston et al.

[11] 4,112,954

[45] Sep. 12, 1978

[54] TESTING OF CIGARETTES

[75] Inventors: Edward George Preston; Eryk Stefan Doerman, both of London, England

[73] Assignee: Molins Limited, England

[21] Appl. No.: 718,371

[22] Filed: Aug. 27, 1976

[30] Foreign Application Priority Data

Aug. 28, 1975 [GB] United Kingdom ..... 35479/75
Nov. 27, 1975 [GB] United Kingdom ..... 48902/75

[51] Int. Cl.[2] ..... A24B 7/14; A24C 5/32

[52] U.S. Cl. ..... 131/21 R; 131/23 R; 73/1 R

[58] Field of Search ..... 131/21 R, 21 B, 94, 131/23 R, 20 R; 53/52; 73/1 R, 157

[56] References Cited

U.S. PATENT DOCUMENTS

| | | | |
|---|---|---|---|
| 3,404,689 | 10/1968 | Schubert | 131/21 R |
| 3,485,084 | 12/1969 | Doerman | 131/21 R |
| 3,491,767 | 1/1970 | Kaeding | 131/21 R |
| 3,793,512 | 2/1974 | Lorenzen | 131/21 R X |
| 3,874,391 | 4/1975 | Dogl et al. | 131/21 R |

*Primary Examiner*—Stephen C. Pellegrino
*Attorney, Agent, or Firm*—Craig & Antonelli

[57] ABSTRACT

A cigarette filter attachment machine with a wrapper testing facility includes means for feeding pieces of tipping paper each of which is wrapped around associated tobacco and filter portions to join those portions to one another; means for testing the wrappers of the cigarettes for leaks; an upsetting device for momentarily upsetting the filter tipping operation to produce at least one cigarette with a deliberate leak in the joint between the tobacco and filter portions; and an ejection device arranged automatically to eject the deliberately faulty cigarette or cigarettes regardless of whether or not the wrapper tester detects the deliberately faulty cigarettes.

16 Claims, 9 Drawing Figures

TESTING OF CIGARETTES

Cigarette making machines, especially machines for making filter-tipped cigarettes, commonly include a wrapper testing device for pneumatically testing the cigarette wrappers and for ejecting cigarettes of which the wrappers allow an excessive leakage of air from the atmosphere into the interior of the cigarette. The present invention is concerned mainly with the provision of means for checking the operation of the wrapper tester.

Filter-tipped cigarettes are commonly made by joining tobacco portions to filters by means of pieces of tipping paper cut from a web of tipping paper. The length of each piece of tipping paper is slightly greater than the circumference of the tobacco portion and of the filter, so that the tipping paper can be wrapped all the way around the adjacent parts of the tobacco portion and filter, with its ends overlapping slightly to ensure that there is a completely secure joint.

One aspect of the present invention concerns a machine for making filter-tipped cigarettes and for testing the wrappers of the cigarettes to detect any which allow an excessive leakage of air into the interior of the cigarette from the atmosphere, comprising means for feeding pieces of tipping paper each of which is wrapped around associated tobacco and filter portions to join those portions to one another; means for testing the wrappers of the cigarettes for leaks; an upsetting device for momentarily upsetting the filter tipping operation to produce at least one cigarette with a deliberate leak in the joint between the tobacco and filter portions; and an ejection device arranged automatically to eject the deliberately faulty cigarette or cigarettes regardless of whether or not the wrapper tester detects the deliberately faulty cigarettes.

By this means, one or more deliberately faulty cigarettes can be produced from time to time to check the operation of the wrapper tester.

In a preferred machine according to this invention the pieces of tipping paper are cut at regular time intervals from a web by a knife, and the upsetting device comprises means for momentarily stopping the web or for reducing the speed at which the web arrives at the knife, so as to produce at least one shorter piece of tipping paper which does not wrap all the way around the associated tobacco and filter portions.

Alternatively, the upsetting device may comprise means for momentarily displacing one edge of the tipping paper from the roller which applies adhesive to the tipping paper, so as to produce at least one cigarette in which the tipping paper is not secured all the way around the tobacco portion, thus leaving a leakage path. Another possibility is that a notch could be cut in one edge of the tipping paper, or one or more perforations could be made in the tipping paper so as to be aligned with the abutting end faces of the tobacco and filter portions.

The identity of the faulty cigarettes can be easily established since the operation of the upsetting device can result in the production of a check signal enabling the faulty cigarette or cigarettes to be ejected at a later stage. The ejection device for the deliberately faulty cigarettes may be seperate from the ejection facility provided for the wrapper tester itself, so that cigarettes which should have been ejected by the wrapper tester but were not can be collected for later examination. In this connection reference is directed to U.S. patent application Ser. No. 546,673, filed Feb. 2, 1975, now U.S. Pat. No. 4,059,120, which is referred to in its entirety.

Alternatively, the checking system according to the first aspect of this invention may be used in combination with the second aspect of this invention described below.

According to a second aspect of this invention, a cigarette testing apparatus includes, or has associated with it, means for forming a deliberate fault in at least one cigarette upstream of a test station at which each cigarette in turn is tested, signal means for producing a check signal indicating the approach of the deliberately faulty cigarette or cigarettes to the test station; and means for indicating if the deliberately faulty cigarette or cigarettes pass the test station without at least one such cigarette being detected at the test station.

In a preferred apparatus according to this aspect of the invention, if the deliberately faulty cigarette or cigarettes pass the test station without at least one being detected at the test station, a warning signal is emitted; for example, a lamp which lights up in response to the check signal to indicate that a test is in progress may be caused to flash on and off repeatedly as a result of the warning signal, or a separate warning lamp may be illuminated by the warning signal. Alternatively the check signal may operate an indicator (e.g. a lamp) and the apparatus may simply be arranged to turn off the indicator in response to the detection of at least one deliberately faulty cigarette at the test station.

The production of a deliberately faulty cigarette may be arranged to occur automatically from time to time or may be under the direct control of the machine operator.

The apparatus preferably includes an ejection device for ejecting each deliberately faulty cigarette regardless of whether or not such cigarette is detected at the test station. That ejection device is preferably also arranged to eject faulty cigarettes detected at the test station; in other words, a single ejection station can be provided instead of the two ejection stations described in U.S. patent application Ser. No. 546,673, filed Feb. 2, 1975 now U.S. Pat. No. 4,059,120.

The deliberate fault may be a wrapper leak which may be made according to the first aspect of this invention. Alternatively, a deliberate leak may, for example, be made by forming holes in the finished cigarettes, by forming holes in the cigarette wrapper paper upstream of the rod-forming section of the machine, or by forming one or more holes in a piece of tipping paper (before it is wrapped around the tobacco portion and filter) in the region of the interface between the tobacco portion and filter.

Another possibility is that the second aspect of this invention could be used to check the device which is sometimes used for testing the ends of the finished cigarettes. For this last purpose, the ends of a few cigarettes may occasionally be deliberately disturbed, for example by means of a suction device which sucks out small quantities of tobacco from the ends of a few cigarettes, and the system may be used to check the correct operation of the ends tester in basically the same manner as described with reference to the wrapper tester.

Examples of machines and systems according to this invention will now be described with reference to the accompanying drawings. In these drawings:

FIG. 1 shows a filter-tipping machine in which double filter-tipped cigarettes are made by joining double-length filters between two tobacco portions. However, this invention is also applicable to a machine in which individual filters are joined to tobacco portions.

Figure 2:
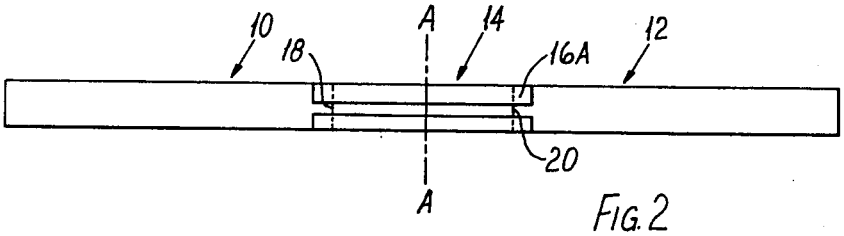
FIG. 2 shows a complete double filter-tipped cigarette with a shortened piece of tipping paper.

FIG. 2 shows a complete assembly comprising two tobacco portions 10 and 12 which are joined to a double-length filter 14 by means of a piece of tipping paper 16A. Normally, the length of the tipping paper is sufficient to go all the way around the assembly and for the ends to overlap slightly. However, the assembly shown in FIG. 2 has a shortened piece of tipping paper leaving deliberate leakage gaps 18 and 20 between the ends of the tipping paper at the interfaces between the abutting ends of the tobacco portions and filter.

Figure 1:
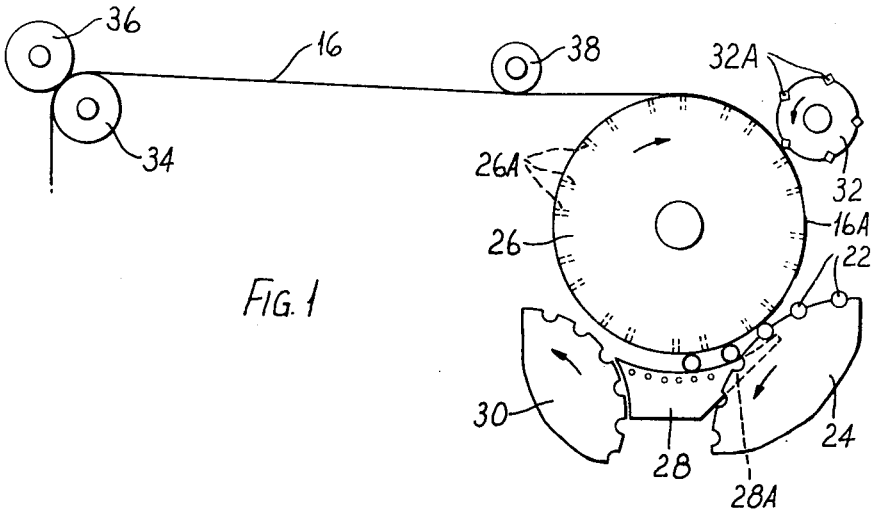
FIG. 1 is a diagrammatic side elevation showing part of a filter-tipping machine.

FIG. 1 shows a succession of such assemblies (identified by the reference numeral 22) being fed by a fluted drum 24 towards a rolling drum 26. Each assembly 22, as it arrives at the drum 26, meets the leading edge of a piece of tipping paper 16A carried by the drum 26 by means of suction applied through radial ports 26A. The assemblies 22 are removed from the drum 24 with the aid of fingers 28A on a rolling plate 28 which cooperate with the drum 26 to roll each assembly, thus wrapping the tipping paper 16A around the assembly. A fluted drum 30 then receives the completed double-length cigarettes, which are subsequently cut through the middle (on the line A—A in FIG. 2) to form two rows of individual filter-tipped cigarettes.

The pieces of tipping paper 16A are cut from a continuous web 16 by a rotary knife 32 which has five circumferentially spaced cutting edges 32A which cooperate with the surface of the drum 26 to cut the web. The web 16 is fed towards the drum 22 by a feed roller 34 with the aid of a cooperating spring-loaded roller 36 which presses the web against the roller 34. On its way from the roller 34 to the drum 26, the web 16 contacts a roller 38 which applies a film of adhesive.

In order to space apart the pieces of tipping paper 16A, as is necessary, the web 16 is fed towards the drum 26 at a speed which is lower than the peripheral speed of the drum 26. Thus the web is kept taut, on its passage between the roller 34 and the drum 26, as a result of being pulled forward by the drum by means of the suction applied through the ports 26A.

In order to reduce the length of at least one piece of tipping paper 16A to produce a deliberately faulty cigarette, the drive roller 34 for the web may itself be driven through a two-speed electro-magnetic clutch or other two-speed drive; in other words, a slightly lower than normal speed may be provided to reduce the length of the tipping paper pieces. Alternatively, the diameter of the roller 34 may be adjustable, i.e. may be momentarily reduced slightly to reduce the forward speed of the web 16.

FIGS. 3 to 6 show different possible ways of temporarily reducing the length of the tipping paper.

Figure 3:
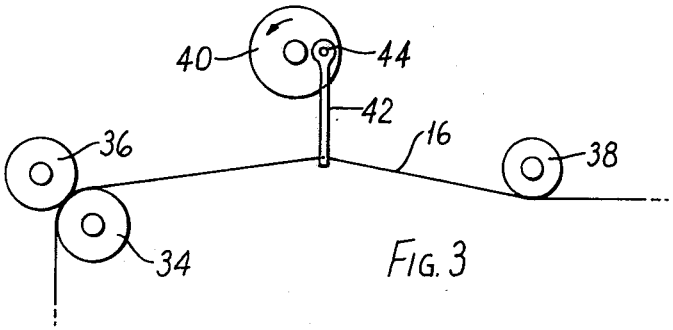
FIG. 3 is a diagrammatic elevation of part of another filter-tipping machine.

FIG. 3 shows an arrangement in which the speed at which the web moves towards the drum 26 is reduced by rotating a wheel 40 which carries a link 42 pivoted to the wheel by a crank pin 44. The lower end of the link 42 is hooked below the web 16. Thus rotation of the wheel 40 in an anti-clockwise direction deflects the web 16 upwards, thus reducing the speed at which the web arrives at the drum 26. The wheel 40 may be driven by a one-revolution clutch at a predetermined speed such as to reduce the length of a few pieces of tipping paper while the crank pin 44 is moving upwards; during the second half of the revolution of the wheel 40, while the crank pin is moving downwards, the web 16 approaches the drum 26 at an increased speed, resulting in slightly longer than usual pieces of tipping paper, but cigarettes made with the temporarily lengthened tipping paper are not objectionable.

Figure 4:
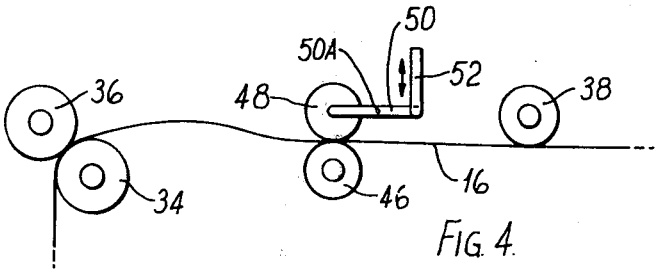
FIGS. 4 to 6 are diagrammatic elevations of parts of other different machines.

FIG. 4 shows an arrangement in which a second feed roller 46 is provided downstream of the roller 34, the roller 46 having a slightly lower peripheral speed than the roller 34. The roller 46 may be continuously driven, but does not retard the web 16 until a pressure roller 48 is moved downwards to press the web against the roller 46. The roller 48 is carried by a lever 50 pivoted at 50A and is controlled as to its movement by a lever 52. When the roller 48 is pressed against the roller 46, a small additional quantity of web is accumulated between the roller 34 and the roller 46. In order to avoid a surge forward of the web when the pressure roller 48 is lifted from the roller 46, the roller 46 may be formed with an elliptical periphery so shaped that it gradually slows down the web and then gradually speeds it up during one revolution of the roller 46; the pressure roller 48 may be shaped as a similar elipse with its major axis 90° out of phase with that of the roller 46.

Figure 5:
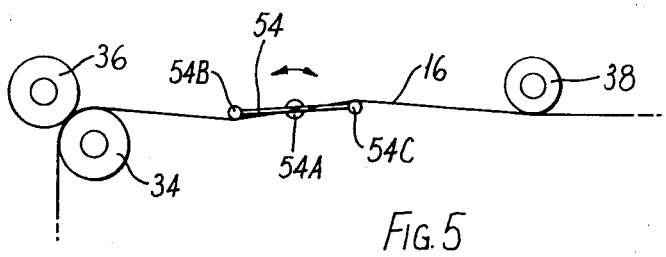

FIG. 5 shows an arrangement in which the web, in passing from the roller 34 to the adhesive roller 38, can be deflected into a zig-zag path by slow rotation of a lever 54 which rotates about an axis 54A and has end members 54B and 54C lying on opposite sides of the web 16.

The lever 54 is rotated slowly in a counterclockwise direction through, for example, about 60° and then slowly back again to the position shown in FIG. 5.

Figure 6:
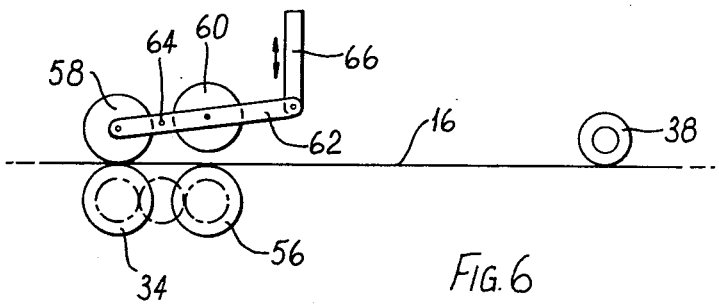

FIG. 6 shows an arrangement in which a second feed roller 56 is provided. This roller is driven continuously through a gear train linking it with the roller 34 and has a slightly lower peripheral speed than the roller 34, for example by virtue of having the same speed but a slightly smaller diameter. Two pressure rollers 58 and 60 are provided respectively above the rollers 34 and 36, the pressure rollers being freely rotatable on a lever 62 which is pivoted to a fixed frame at 64 and is controlled as to its movement about the pivot 64 by a lever 66. Downward movement of the lever 66 results in the pressure roller 58 being lifted from the feed roller 34, while at the same time the pressure roller 60 is lowered onto the feed roller 56 so as to reduce momentarily the speed of the web 16.

Figure 7:
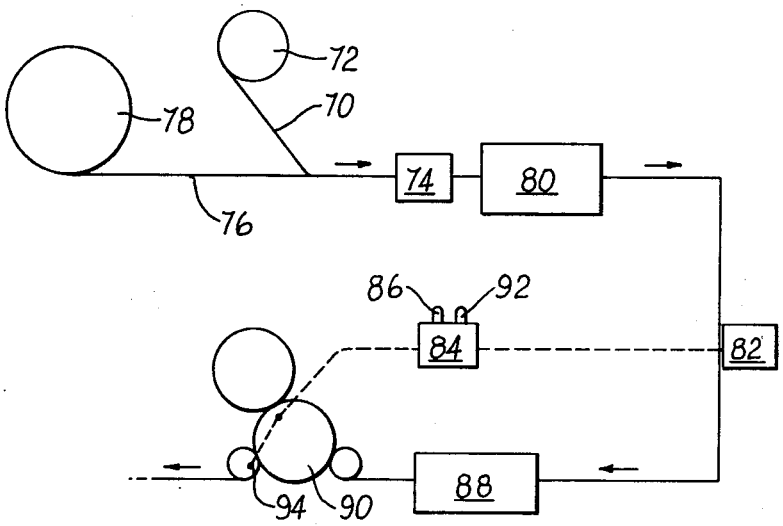
FIG. 7 is a diagrammatic illustration of a complete system.

FIG. 7 shows a system according to the second aspect of this invention. A web of cigarette paper 70 is drawn from a reel 72 and passes through a splicing device 74 which includes provision for joining the web 70, just before it expires, to the leading end of a fresh web 76 drawn from a reel 78. The splicing device 74 also includes a member which, when the webs are stationary for splicing, forms holes in the web in the region of the splice. For example, the splicing operation may involve movement of a spike member (not shown) which forms a number of holes in the web, at spaced positions along the web, as the splice is made.

The splicing mechanism also includes a reservoir 80 in which cigarette paper is accumulated by overfeeding just before splicing, so that a continuous delivery of paper from the reservoir 80 can occur while the splice is being made. The splicing mechanism may be basically as described in British patent specification No. 1,086,065.

Downstream of the splicing mechanism there is a detector device 82, for example, a photo-electric splice detector or a suction transducer sensitive to the porosity of the paper at the splice, and this detector device emits a signal when a splice passes it. This signal is fed to a device 84 which illuminates a red lamp 86 to indicate that a splice together with perforated cigarette paper is on the way. Downstream of the detector device 82 there is a rod forming device 88 in which the cigarette paper is wrapped around a stream of tobacco to form a continuous cigarette rod which is subsequently cut into individual cigarette sections. The cigarette sections then pass to a wrapper testing device 90 which pneumatically tests the wrapper of each cigarette to detect any excessive leak.

It will be understood that the wrapper tester 90 is expected to detect the cigarettes with the deliberate holes in the wrapper. Assuming it does that, a signal from the tester 90 causes a green lamp 92 to be lit and causes the red lamp 86 to be extinguished. The device 84 includes a memory whereby cigarettes with the deliberate holes are ejected at an ejection station 94 immediately downstream of the wrapper tester 90. The ejection station 84 is also used to eject cigarettes found faulty by the wrapper tester 90. For example, a system of the type disclosed in the Esenwein U.S. Pat. No. 3,412,856 may be used, wherein the memory takes the form of a shift register.

Figure 8:
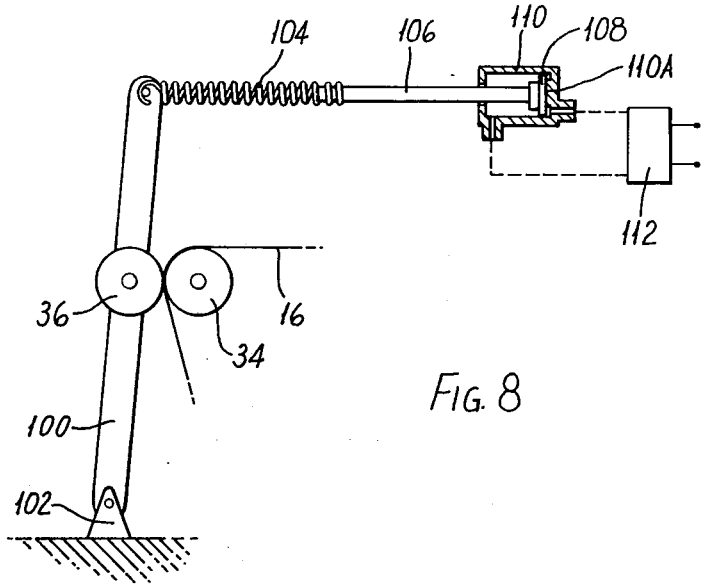
FIG. 8 is a diagrammatic elevation of part of another filter-tipping machine.

FIG. 8 shows an arrangement in which a tipping paper web 16, on its way to the rolling drum 26 shown in FIG. 1, is driven by a roller 34 with the aid of a pinching roller 36. The roller 36 is rotatably mounted on a lever 100 which is pivoted at its lower end to a stationary part 102 and is urged in a clockwise direction about the pivot axis by a tension spring 104. This spring has one end connected to the upper end of the lever 100 and the other end connected to a piston rod 106 which carries a piston 108 in a cylinder 110. Air can be supplied to either end of the cylinder 110 via a solenoid-operated valve 112.

During normal operation, air is supplied to the left-hand end of the cylinder 110, and the piston 108 is thus held against an abutment 110A in the cylinder (as shown). Tension in the spring 104 is then sufficient to press the tipping paper web 16 against the roller 34 to provide a positive drive for the web; that is to say, the web moves at the peripheral speed of the roller 34.

In order to produce a shortened piece of tipping paper, the valve 112 is switched over so as to exhaust the left-hand end of the cylinder 110 while at the same time admitting compressed air to the right-hand end of the cylinder so as to move the piston 108 temporarily to the left-hand end of the cylinder. As a result, the tension in the spring 104 is considerably reduced by a predetermined amount, and the pressure of the roller 36 on the tipping paper web drops to a level at which the tipping paper web 16 can slip slightly with respect to the roller 34. Thus, a shorter than usual piece of tipping paper is cut from the leading end of the tipping paper on the rolling drum 26 (FIG. 1).

An alternative arrangement is as follows. The tipping paper web 16 is permanently pressed firmly against the driving roller 34. However, the roller 34 is driven via an electro-magnetic or other readily disengageable clutch which is momentarily disengaged to produce a short piece of tipping paper when required. With this arrangement, when the clutch is disengaged, the forward movement of the tipping paper web stops or slows down briefly; the forward drive provided by the rolling drum 26 is not sufficient on its own to move the web 16 at its normal speed.

Alternatively, a slipping clutch may be provided in the drive to the roller 34, and the system may include an electro-magnetic or pneumatically operated brake which momentarily stops or slows down the driven end of the slipping clutch.

Figure 9:
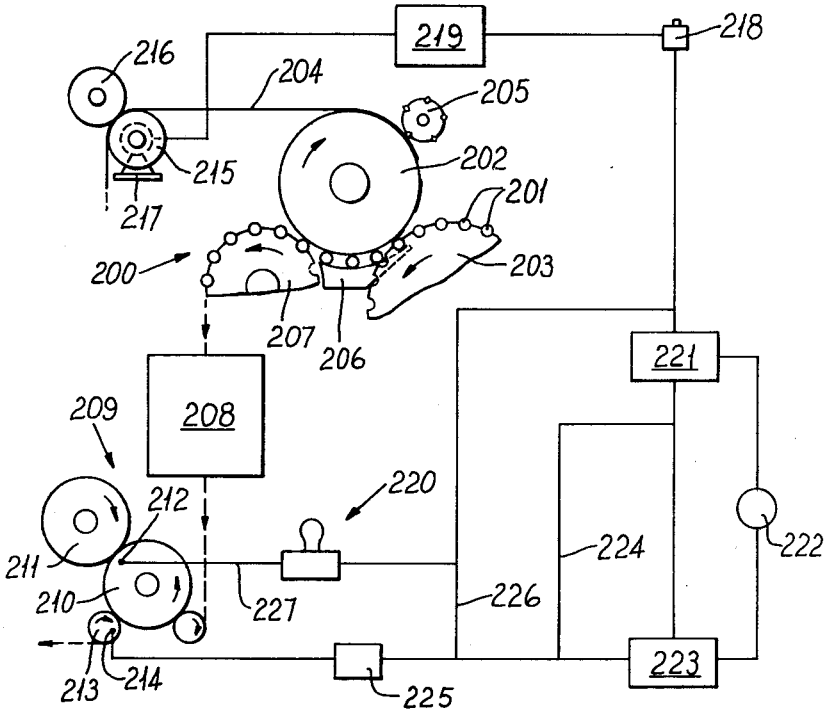
FIG. 9 is a diagrammatic illustration of another complete system.

FIG. 9 shows diagrammatically another complete system for checking the operation of a cigarette wrapper tester.

The system as shown in FIG. 9 includes a filter-tipping machine 200 by which pairs of tobacco portions are joined to opposite ends of double-length filter portions. Successive assemblies 201 each consisting of two tobacco portions with an interposed double-length filter portion are carried towards a rolling drum 202 by a fluted drum 203. Each assembly 201 arrives at the rolling drum 202 in time to meet the leading edge of a piece of tipping paper which is cut from an adhesive-coated web 204 by a rotary knife 205. A rolling plate 206 rolls the assemblies and thus wraps the joining paper pieces around the assemblies to form double filter-tipped cigarettes which are received by a further fluted drum 207.

The double filter-tipped cigarettes are then cut through the middle to form two rows of individual filter tipped cigarettes (in a well known manner) which are fed to a tip-turning device 208 by which the cigarettes of one row are inverted and are placed between the cigarettes of the other row so as to form a single row of filter-tipped cigarettes all similarly orientated. The tip turner device may, for example, be as described in British patent specification No. 1,149,312. The filter-tipped cigarettes are then fed to a cigarette wrapper tester 209, which may be as described in British patent specification No. 1,217,203. The device 209 comprises two drums 210 and 211 by which the wrappers of the cigarettes are pneumatically tested at the tangent point 212 between the drums. The cigarettes are then received by a transfer drum 213; faulty cigarettes are blown off the drum 213 by an axially-directed air jet at the point 214.

The tipping paper web 204 is fed towards the rolling drum 202 by a pulley 215 against which the web is pressed by a spring-loaded pulley 216. The pulley 215 is driven by a electric motor 217 via an electro-magnetic clutch of a well-known kind.

In order to check the operation of the wrapper tester 209, the operator presses a button 218. This causes a circuit 219 to de-energise the electro-magnetic clutch driving the pulley 215 for a predetermined short period, thus slowing down or momentarily stopping the pulley 215 and causing a short piece of tipping paper to be cut from the web 204, that is to say, a piece which will produce a double cigarette as shown in FIG. 2.

Pressing of the button 218 also results in the lighting up of a lamp 220 adjacent to the cigarette inspection device (indicating that a test is in progress) and produces an input signal to a memory device 221. The memory 221 comprises a counter operating in time to a pulse signal received from a device 222 which produces pulses at the speed at which cigarettes pass a given point in the system in a well known manner. After a predetermined pulse count (which is adjustable) the memory device 221 transmits a signal via a line 224 to an ejection device 225 and also transmits a signal to the input of a second memory device 223. After a predetermined (adjustable) number of counts, the memory device 223 produces another signal which is also fed to the ejection device 225. On receiving each signal, the ejection device 225 (which includes a solenoid valve in a well known manner) produces an air jet at the ejection point 214 by which a small group of cigarettes is ejected from the drum 213, including the deliberately faulty cigarettes.

The reason for using two memory devices is as follows. The action of the tip turner 208 results in one half of each double filter cigarette (the half which is inverted) being delayed with respect to the other half since it moves along a longer path. In other words, assuming that only one deliberately faulty double cigarette is produced by the operation of the button 218, one half of that double cigarette (forming an individual filter-tipped cigarette) will arrive at the wrapper tester a predetermined number of counts after the other half. Accordingly, the first memory device 221 is set so as to transmit a signal to the ejection device 225 when the first half arrives at the ejection point 214, and the second memory device 223 is set so as to transmit another signal a predetermined number of counts later, so that the other half is ejected at the ejection point 214.

The memory devices 221 and 223 and the ejection device are set so as to eject the deliberately faulty cigarettes at the ejection point 214. A connection 226 is also made from the output of the memory devices to the lamp unit 220, and the lamp unit 220 also receives a signal via a line 227 whenever a faulty cigarette is detected at the wrapper test station 212. The lamp unit 220 has a circuit which causes the lamp to flash repeatedly on and off if the deliberately faulty cigarettes pass the wrapper test station without at least one deliberately faulty cigarette being detected by the wrapper tester. The flashing lamp indicates to the operator that the wrapper tester is not working correctly.

The tip turner 208 may be omitted if the filter tipping machine is arranged to join individual filters to individual cigarettes, producing a single stream of filter-tipped cigarettes. Another, possible modification is that the wrapper tester may be arranged to test the double filter-tipped cigarettes, i.e. before the double cigarettes are cut through the middle to produce two rows of individual cigarettes. With either of these modifications the second memory device 223 would be omitted.

We claim:

1. A machine for making filer-tipped cigarettes and for testing the wrappers of the cigarettes to detect any which allow an excessive leakage of air into the interior of the cigarette from the atmosphere, comprising means for feeding pieces of tipping paper each of which is wrapped around associated tobacco and filter portions to join those portions to one another; means for testing the wrappers of the cigarettes for leaks; an upsetting device for momentarily upsetting the filter tipping operation to produce at least one cigarette with a deliberate leak in the joint between the tobacco and filter portions; and an ejection device arranged automatically to eject the deliberately faulty cigarette or cigarettes regardless of whether or not the wrapper tester detects the deliberately faulty cigarettes.

2. A machine according to claim 1 in which the pieces of tipping paper are cut at regular time intervals from a web by a knife, and in which the upsetting device comprises means for momentarily stopping the web or for reducing the speed at which the web arrives at the knife, so as to produce at least one shorter piece of tipping paper which does not wrap all the way around the associated tobacco and filter portions.

3. A machine according to claim 2 in which the web of tipping paper is fed towards the knife by a pulley and in which the upsetting device momentarily disengages the drive to the pulley.

4. A machine according to claim 2 in which the web of tipping paper is fed towards the knife by a pulley and in which the upsetting device momentarily reduces or eliminates the pressure with which the web is pressed against the pulley.

5. A machine according to claim 2 in which the web of tipping paper is fed towards the knife by a pulley and in which the upsetting device momentarily slows down the pulley.

6. A machine according to claim 2 in which the web of tipping paper is fed towards the knife by a pulley and in which the upsetting device momentarily deflects the web downstream of the pulley.

7. A filter-tipping apparatus for use in a machine according to claim 1, comprising means for feeding a web of tipping paper; a knife for cutting the web at regular time intervals to produce pieces of tipping paper each of which is wrapped around associated tobacco and filter portions to join those portions to one another; and means for momentarily stopping the web or for reducing the speed at which the web arrives at the knife to form at least one shorter piece of tipping paper which does not wrap all the way around the associated tobacco and filter portions, thus producing at least one deliberately faulty cigarette whereby the operation of a cigarette wrapper tester receiving the cigarettes can be checked.

8. A cigarette testing apparatus including, or having associated with, means at a test station for testing cigarettes, means for conveying cigarettes to said test station, means for forming a deliberate fault in at least one cigarette upstream of said test station at which each cigarette in turn is tested, signal means for producing a check signal indicating the approach of the deliberately faulty cigarette or cigarettes to the test station; and means responsive to said signal means and said testing means for indicating if the deliberately faulty cigarette or cigarettes pass the test station without at least one such cigarette being detected at the test station.

9. Apparatus according to claim 8 wherein said indicating means includes second signal means for producing a warning signal if the deliberately faulty cigarette or cigarettes pass the test station without at least one such cigarette being detected at the test station.

10. Apparatus according to claim 8 including an ejection device downstream of said test station for ejecting each deliberately faulty cigarette regardless of whether or not such cigarette is detected at the test station.

11. Apparatus according to claim 10 in which the ejection device is also arranged to eject faulty cigarettes detected at the test station.

12. Apparatus according to claim 11 including a memory device, operated on the basis of a cigarette count, whereby the ejection device is actuated when the deliberately faulty cigarette reaches it.

13. Apparatus according to claim 8 which is associated with a filter attachment machine, and in which the means for forming a deliberate fault in at least one cigarette comprises means for momentarily upsetting the filter tipping operation to produce at least one cigarette with a deliberate leak in the joint between the tobacco and filter portions.

14. A machine for making filter-tipped cigarettes and for testing the wrappers of the cigarettes to detect any which allow an excessive leakage of air into the interior of the cigarette from the atmosphere, comprising means for feeding pieces of tipping paper each of which is wrapped around associated tobacco and filter portions to join those portions to one another; means for testing the wrappers of the cigarettes for leaks; an upsetting device for momentarily upsetting the filter tipping operation to produce at least one cigarette with a deliberate leak in the joint between the tobacco and filter portions; an ejection device arranged automatically to eject the deliberately faulty cigarette or cigarettes regardless of whether or not the wrapper tester detects the deliberately faulty cigarettes; and means for indicating if the deliberately faulty cigarette or cigarettes pass the test station without at least one such cigarette being detected at the test station.

15. A machine according to claim 14 in which the pieces of tipping paper are cut at regular time intervals from a web by a knife, and in which the upsetting device comprises means for momentarily stopping the web or for reducing the speed at which the web arrives at the knife, so as to produce at least one shorter piece of tipping paper which does not wrap all the way around the associated tobacco and filter portions.

16. A machine according to claim 14, further including signal means for producing a check signal indicating the approach of the deliberately faulty cigarette or cigarettes to the test station.

* * * * *